United States Patent [19]

Motai

[11] 4,194,033

[45] Mar. 18, 1980

[54] PROCESS FOR TREATING WOOD

[75] Inventor: Takeji Motai, Chofu, Japan

[73] Assignee: Shin-Asahigawa Co., Ltd., Japan

[21] Appl. No.: 924,834

[22] Filed: Jul. 14, 1978

[51] Int. Cl.[2] ..... B05D 3/12; B05D 3/02

[52] U.S. Cl. ..... 427/351; 427/370; 427/377; 427/382; 427/397; 427/440; 428/907

[58] Field of Search ..... 427/351, 370, 382, 377, 427/397, 393, 440; 428/907

[56] References Cited

U.S. PATENT DOCUMENTS

| | | | |
|---|---|---|---|
| 3,183,114 | 5/1965 | Liu et al. | 428/541 |
| 3,985,921 | 10/1976 | Rowell et al. | 427/397 X |

*Primary Examiner*—Michael R. Lusignan

*Attorney, Agent, or Firm*—Wenderoth, Lind & Ponack

[57] ABSTRACT

A process for treating wood consisting of boiling the wood in a solution containing alkylamine and then transferring the boiled wood to an autoclave where an alkylamine permeating solution is forced into the wood under the conditions of pressure and heat. The wood is then dehydrated under reduced pressure and is then air dried.

6 Claims, No Drawings

PROCESS FOR TREATING WOOD

SUMMARY OF THE INVENTION

The present invention relates to a process for treating wood to eliminate defects such as warps or cracks.

In recent years, because of the rapid depletion of usable wood resources, utilization of thus far unusable wood or low quality wood for building homes and fabricating furniture and the more effective utilization of such wood have become important issues. The demand for homogeneous wood that can be fabricated with a high degree of precision and which has stable physical properties without defects such as warping, discoloration, and rot has been very strong. There has been a growing need for a way to process low quality unusable wood that will remove its defects and transform it into a usable wood resource.

Heretofore, in order to eliminate such defects, various chemical or physical treating processes have been proposed, but most are still in the laboratory stage. Only one industrial method (Japanese patent publication No. 50-7121, Japanese patent application No. 49-3291) has been proposed wherein, for example, larch is dipped in a solution prepared by adding a surface active agent to an aqueous solution of soda ash ($Na_2CO_3$) or is subjected to a resin removing treatment to eliminate defects such as warping to achieve separation of resin by boiling under pressure, thus obtaining a good quality wood.

However, this process can be applied only to relatively thin planks, and long periods of time are required for achieving the treatment. The mixing of the surface active agent prevents the permeation of the aqueous solution of soda ash into the wood since the surface active agent tends to gel easily and tends to be unstable at high temperatures during the treatment. Thus, boiling, steaming and permeation are uneven and the parts of the wood eluted by the soda ash remain inside the wood, resulting in more defects such as deterioration, and discoloration than are present untreated wood.

Also, maintenance of the equipment is not easy since the metal surfaces of the exposed portion of the inside of the boiler are corroded due to the combination of soda ash and high temperature steam. The interface of the dipping tank and the pressure boiler contact a soda ash solution. The biggest defect of this treating process is that the defective portions of the wood ingredient eluted from the wood by the soda are discharged in a dissolved state after the treatment. This waste solution or effluent consists of an aqueous solution of soda ash and various substances or the soda ash, and surface active agent. Since both BOD and COD are much higher than the allowable values, the process effluents cannot be drained into rivers from the standpoint of pollution control and effluent treatment is necessary. However, the effluent eluted from the wood by the soda ash is difficult to condense and precipitate, and separation is immensely difficult. The effluent containing the surface active agent produces a large amount of bubbles and since it kills microorganisms, treatment by the activated sludge process is extremely difficult. Thus, large installation expenses and treating expenses are required for pollution control so that the type of process described above is not industrially and economically feasible. Furthermore, when the wood is treated by steaming, using soda ash at high temperatures, a phenomenon similar to the one which occurred in case of caustic soda occurs. Resin, rubbery substances, chalky substances, hemicellulose and other undesirable substances in the wood give rise to warping. The wood also often breaks down into pulp after the treatment. The soda ash remaining inside the wood after the treatment produces discoloration and as a result, deterioration of the wood is hastened.

The present invention has been conceived to avoid the foregoing drawbacks of conventional processes mentioned above and to provide suitable process for treating wood economically on an industrial scale.

Namely, the present invention uses alkylamines, the molecular weight of which is about 100 and the boiling point of which is above 90° C. such as particularly, triethylamine $(C_2H_5)_3N$, ethylbutylamine $(C_2H_5)_2(C_4H_9)NH$, diethylaminoethanol $(C_2H_5)_2(C_2H_4OH)N$ as treating agents. The gist of the invention resides in the fact that this dilute aqueous solution is used to impregnate and treat the wood.

The detailed description of the present invention follows. It is possible to treat the wood with a 0.1–0.5% aqueous solution using the above-mentioned alkylamine as a treating agent by employing conventional process of dipping, dipping and boiling or pressure steaming. However, in the case of the effective wood treating process of the present invention, the procedures are: (1) pretreatment process A whereby the wood is dipped in an alkylamine aqueous solution, and is heated so that the aqueous solution gradually rises from room temperature to 92°–98° C. The wood is boiled at this temperature for a fixed time. Then, (2) the main treatment process B is carried out wherein the wood treated by the foregoing treatment process A is dipped in an aqueous alkylamine solution in a special autoclave that is used to apply and manipulate such factors as heating, pressurizing and reducing pressure to carry out the process. After heating and boiling, the pressure is reduced to drain the alkylamine solution, used in the heating and boiling process, from the treated wood in the autoclave and, at the same time, the pressurized, heated and boiled wood is subjected to a reduction of moisture content down to fiber saturation point. Next comes, the (3) drying process C wherein the treated wood is dried artificially or naturally or both artificially and naturally. Another part of the process is (4), the waste solution effluent treating process D (pollution control process) of the process effluent drained off and discharged from the foregoing processes A and B. During the treatment process, the pretreatment process A is adjusted for wood having different moisture content, specific gravity, molecular composition in order to soften the wood without destroying the molecular structure and to facilitate the permeation of alkylamine which gives plasticity to the treated wood to eliminate or transform the various components of the wood which are regarded as the factors causing defects such as warping, etc. into an easily dissoluble condition and, at the same time, to dissolve and separate out the resin component which can be relatively easily dissolved with hot aqueous solution of alkylamine along with the hemicellulose, rubbery substances and chalky substances from the inside of the wood. The main treatment process B aims at subjecting the wood treated by pretreatment process A to pressurizing, heating and boiling processes to open pit chambers, pits, perforations, etc. to smooth out the flow of the liquid and gas in the wood; to permeate and disperse alkylamine continuously in the wood structure; to soften, dissolve and separate the closed structures such as tylosis, tracheid, resin canals, parenchyma, as well as affecting non-homogeneous portions of the wood structure resulting from the excessive presence of various components such as resin, hemicellulose, rubbery materials, chalky materials, crystallized mineral materials, and other waste substances which are factors contributing to defects of the wood. Defects not thus entirely removed are corrected. The dissolved substances removed from the wood are washed out by the hot water during boiling of the wood. These various substances and the excess water remaining from the foregoing process are removed by techniques based on reduced pressure. The moisture content is lowered to the fiber saturation point of the wood to facilitate drying. The effluent or solution drained off, consisting of the various components of the wood separated from the wood in the foregoing treatment processes A and B cause problems with regard to pollution control. Treatment of this waste solution (process D) is one of the important elements constituting the present invention. These effluents are collected in a holding tank temporarily. Inorganic or organic floccing agents are added so that the colored substances separated from the inside of the wood by the alkylamine treatment process as per the present invention form flocs and are easily precipitated and separated into the supernatant liquid and a sludge-type substance. This supernatant liquid can be reused in the treatment processes A or B after adjusting the concentration of alkylamine. The precipitated and separated sludge can be salvaged as fuel or organic fertilizer.

In the present invention, treatment specifics such as the concentration of the aqueous solution of alkylamine and treatment time depend on the species of wood, and particularly on the chemical and molecular composition of the substances regarded to be defects in the wood to be treated which has various specific gravities, thicknesses, initial moisture content and resin levels. Thus, the treatment specifics must be determined according to the kind of species to be treated. If the wood to be treated has high specific gravity, thickness, initial moisture content, and high resin content, severe treatment specifications are required. In the case where the wood has been subjected to the foregoing pretreatment process A and the main treatment process B, the concentration of alkylamine can be set to a constant value such as 0.2% in treatment process B since it has undergone the pretreatment process A. But for pretreatment process A, depending on the wood, 0.1–0.5% concentrations are used. For the pretreatment process A, the time required for elevating the solution temperature to 92°–98° C. and time required for boiling at 92°–98° C. for the former (0.1%) is 20–120 minutes. For the latter (0.5%), 1–9 minutes per 1 mm of thickness of the wood are required. Moreover, during treatment process B, a steaming time of 0.5–2 minutes is required per 1 mm thickness with pressure at 1.5–2.0 kg/cm$^2$. However, the required conditions for the pressure reducing part of the process do not vary by type of wood since the wood is generally homogenized by the pretreatment process A and the main treatment process B. Therefore, boiling time can be set almost constant at one minute per 1 mm of thickness of the wood under a reduced pressure of 300–500 mm/Hg. Also, the process effluent can be treated by employing a conventional method using a floccing agent of the cation type such as aluminum sulphate, ferric chloride, ammonium polychloride or an anion type molecular floccing agent such as sodium polyacrylate, sodium polystyrene sulphonate, a non-ion type of molecular floccing agent such as polyacrylamide, or cation type molecular floccing agent such as aqueous aniline resin. Also, in order to help prevent decay in the treated wood, a serious defect of wood and damage by insects, it is possible to treat the wood by using a solution prepared by adding a normally used antiseptic and insecticide to the alkylamine aqueous solution of the present invention. Moreover it is possible to dye the treated wood by treating the wood with a solution prepared by adding a coloring agent to the alkylamine aqueous solution of the present invention.

According to the present invention, the alkylamine of the present invention diffuses and permeates into the wood very effectively when it is used in aqueous solution. For example, pieces of Japanese red pine wood 250 mm square are boiled for 30 minutes (treatment conditions: initial moisture content 15%, boiling temperature 95°–98° C.). When a 0.2% aqueous solution of ethylbutylamine of the present invention and 0.2% aqueous solution of sodium dodecylbenzene sulphonate (anion activator), which is normally used as permeating agent, are caused to permeate into the core portions from the surface of the test pieces and are compared with respect to the depth of permeation of each respective solution, as shown in the results of the test in Table 1, the former has permeability almost double that of the latter. Moreover, alkylamine has the capability of, for example, plasticizing and softening the wood structure. The hot alkylamine solution has extremely high dissolving characteristics with regard to resin components in the wood. It affects the water solubility which neutralizes and disperses the acid content of the wood. Therefore, the wood of relatively large cross section can be treated with the solution of the present invention which homogenizes the wood by easily and rapidly dissolving various components constituting defects of the wood, which cause warping as mentioned in the foregoing, and render the color of the wood uniform to produce a satisfactory appearance. Also, the alkylamine does not cause the wood to deteriorate with alkylamine remaining in the wood after the treatment since it forms a stable amine salt by reacting with the acid content in the wood and the amine salt helps to make the treated wood useful for home building and wood work of extremely high precision and physical stability. Such wood can be obtained from wood materials having a high degree of defects by use of the process embodied in the invention.

Furthermore, the alkylamine of the present invention has the effect of forming a protective film on metal surfaces instead of causing corrosion and thus protects against normal oxidation corrosion by forming a protective film on metal surface so that maintenance of the treating equipment is trouble free. Yet the treatment of the used solution which contains a large volume of deep colored effluent from the wood separated out by the aqueous alkylamine solution reacts with the substances removed from the wood, particularly with a terminal COOH group of the acid substances to form a sodium salt (—COONa) which has aqueous properties and can be broken down. This differs from the conventional alkaline method of holding the aqueous property constant, for example, the soda ash method. In the present invention, amine salts such as —COON—R—R′ change to water insoluble substances, so that, as per Table 2, they are easily aggregated by using common inorganic and organic floccing agents. The condensate precipitates in a short time and the precipitate is separated into the supernatant liquid and a sludge-like substance.

Since the colored substance separated from the wood is flocced and precipitated, it can be easily transformed into a transparent waste solution. This solution can be used over again many times through recycling by adjusting the concentration of the alkylamine. As described in the foregoing, the present invention has pronounced effects in preventing wood defects, generating almost no pollution and achieving enormous effects in saving energy. It is an epoch-making wood treating process, industrially and economically, with surprisingly low cost of installation and maintenance.

In table 2, besides the foregoing advantages of the process, as the results of an analysis of the process effluent show, the agents showing values for BOD/COD closer to 1 have high solubility, but with the present invention, its values of 0.97–0.98 are far closer to 1 as compared with the conventional process (see Table). There is no need to adjust the pH of the waste solution for the purpose of treatment. The Table clearly shows the feasibility of the treatment of the process effluent, i.e. waste solution.

Examples of the present invention will be described in the following.

EXAMPLE 1.

Various species described in Table 3 were treated under the conditions wherein a boiling tank equipped with a heating device (depth: 2 m, width: 4 m and length 5 m) and a pressure boiler equipped wtih a device (diameter: 1.8 m and length: 4.5 m) that can be manipulated to apply pressure and heat and to reduce pressure are employed and aqueous solution of diethylamine was used. The woods were dried to about 10% moisture content. Moreover, 1000 ppm of aluminum sulphate and 50 ppm of sodium polyacrylate (anion type) were added to the process effluent produced by the process. The effluent was stirred and the resulting solution was left standing for about 2 hours after which the supernatant was recovered.

EXAMPLE 2

An example similar to the one described in the above Example 1 wherein as the treating agent, trimethylamine was used.

EXAMPLE 3

An example similar to the one described in the above Examples 1 and 2 wherein as the treating agent, diethylaminoethanol was used.

EXAMPLE 4

An example described in the above Examples 1, 2 and 3 wherein as the coloring agent, brown-red coloring pigment (10 micron fine grained particles) was added to the treating agent.

EXAMPLE 5

An example like the one described in the above Examples 1, 2, 3 and 4 wherein as a rot preventive and insecticide, a mixed emulsion of chlordane and organic tin compound was added to the treating agent.

As described in the foregoing, the treated wood is almost free of the defects of the original material wood such as warp without relation to the species and shape of the wood treated, i.e. round wood, thick planks, thin planks, etc. An enormous volume of hitherto unusable wood which has not been utilized conventionally on account of defects and separation of resin can now be properly utilized. For example, unusable wood such as low value larch can be used as high grade decorating wood for such purposes as alcove posts, rafters, polished logs. It may also be employed for machined angular columns and decorated angular columns, or can be utilized in many other ways such as structural wood, e.g. square studs in heartwood, rafters, collar beams, lumber joists, and also as high grade furniture wood, toy wood, collective studs and structural decorating wood. The treated wood is almost free from defects such as sapwood, heartwood, sapwood and heartwood mixed, reaction wood, knots, bark pockets and unhomogeneous wood structure, and warps arising from the uneven distribution of physical properties, or defects. Moreover, the wood has minimal defects in shape and dimension. Thus, treated wood can be cut by square sawing, plain sawing or round sawing producing considerable economic advantages and yields can be raised substantially.

The treated wood can be subjected to complicated machining, grooving, boring, etc. Even if the wood is stored for long periods, there is almost no less. Therefore, such wood can be used for items with unsteady demand which require high quality, such as moldings, furniture wood and door and window wood. Furthermore, since the colors of the wood are uniform, and color change of the wood is extremely small, the treated wood exhibits great utility in the uses requiring fabricating precision such as wood for moldings, for furniture, doors and windows as well as musical instruments. Furthermore, cutting and polishing properties are improved, and machinability is increased. Treated wood takes paint well. Resin has been eliminated, and therefore, bonding power is improved by 20–30%. Moreover, uniform coating is achieved. Since the treated wood has increased its surface hardness by 20–25%, it becomes possible for relatively soft material wood to be utilized for high surface hardness jobs such as floor material and table material.

In the examples, the supernatant of the final effluent, after the used treatment solutions have been subjected to effluent treatment is recycled for reuse, eliminating pollution, and achieving energy savings of about 90%. The economical effects of the process in the elimination of defects of wood and defatting are a great stride forward. The sludge which is precipitated and separated out can be utilized as feed for earthworms or as an extremely good quality organic fertilizer.

Table 1

Permeation and diffusion test for wood
(Portions other than permeating surface are sealed off in accordance with provisions of JIS-2-2104)

| | Average annual | Moisture content of test | Specific |
|---|---|---|---|

Table 1-continued

Permeation and diffusion test for wood
(Portions other than permeating surface are sealed off in accordance with provisions of JIS-2-2104)

| Test material | Dimension (mm) | Permeating surface | ring (mm) | wood (%) | gravity (gas dried) | Treating agents |
|---|---|---|---|---|---|---|
| Red pine (Shinshu (area) 60 years | 250 × 250 × 2000 | cut end | 2.9 | 15 | 0.55 | anionic activator sodium docybelbenzene sulphonate soda ash |
| | " | side | 2.9 | 15 | 0.55 | " |
| Number of test woods (cut end, side) | " | cut end | 2.8 | 15 | 0.55 | alkylamine (ethylbutylamine) |
| Treating agent 5 pieces each | " | side | 2.8 | 15 | 0.55 | " |
| | " | cut end | 2.9 | 15 | 0.55 | none |
| | " | side | 2.9 | 15 | 0.55 | " |

| Test material | Concentration of treating agents (%) | Temperature of treating agents | Treating time (min.) | Permeation (average of both cut ends or four sides) (mm) | Average permeation depth (average value of 5 test woods) (mm) |
|---|---|---|---|---|---|
| Red pine (Shinshu area) 60 years | 0.2 | 95°-98° C. | 30 | 29-50 | 38 |
| Number of test woods (cut end, side) | 0.2 | " | 30 | 9-17 | 13 |
| Treating agent 5 pieces each | 0.2 | " | 30 | 62-108 | 85 |
| | — | " | 30 | 18-26 | 22 |
| | — | " | 30 | 25-46 | 37 |
| | — | " | 30 | 7-11 | 9 |

Table 2

Treatment of waste solution (process effluent)

| Method of treatment | Name of treating agent | pH | Non-evaporated ingredient | Analysis of waste solution: COD | BOD | BOD/COD | Color |
|---|---|---|---|---|---|---|---|
| Method of this invention | 0.2% ethylbutylamine | 9.6 | 2.20% | 2050 | 2009 | 0.98 | brown(13) |
| | 0.4% ethylbutylamine | 10.5 | 2.22 | 2130 | 2066 | 0.97 | "(13) dark |
| Conventional method | 0.2%$Na_2CO_3$ + 0.2%ABS | 9.3 | 0.50 | 1550 | 698 | 0.45 | brown(17) |
| | 0.3%$Na_2CO_3$ | 9.4 | 0.70 | 1350 | 810 | 0.60 | "(17) light yellow green (1) |
| Control | water | 4.9 | 0.20 | 1060 | — | — | |
| Control | 0.2%ABS | 5.3 | 0.37 | 1115 | — | — | "(1) |

Remark:
(1) Waste solution is treated waste solution of larch.
(2) In color column, numerical values ( ) indicate Gardner Color No.

| Method of | When 1000 ppm aluminum sulphate and 50 ppm of sodium polyacrylate (anion type) are added. Rate of elim-ina- | Rate of elim-ina- | When aggregating agent is added after waste solution is adjusted to pH7 Rate of elim-ina- | Rate of elim-ina- | Color and separating characteris- |
|---|---|---|---|---|---|

Table 2-continued

| | Treatment of waste solution (process effluent) | | | | | | | | | | |
|---|---|---|---|---|---|---|---|---|---|---|---|
| treatment | pH | COD | tion | BOD | tion | pH | COD | tion | BOD | tion | tics |
| Method of this invention | 6.1 | 902 | 56% | 824 | 59% | 6.2 | 923 | 55% | 804 | 60% | light yellow(1) |
| | 6.5 | 809 | 62 | 723 | 65 | 6.7 | 916 | 57 | 785 | 62 | good, transparent |
| Conventional method | 9.1 | 1488 | 4.0 | 661 | 5.3 | 9.1 | 1372 | 11.5 | 621 | 11.1 | brown (13) |
| | 9.0 | 1326 | 1.8 | 786 | 3.0 | 9.0 | 1276 | 5.5 | 737 | 9.0 | separation is poor, turbidity present |
| Control | 3.9 | 1044 | 1.5 | — | — | 4.0 | — | — | — | — | yellow (2) |
| Control | 4.8 | 1096 | 1.7 | — | — | 4.9 | — | — | — | — | no separation, turbidity present |

Table 3

| | | Treating condition (temperature 92°-98° C.) by boiling tank in pretreating process (A) | | |
|---|---|---|---|---|
| Representative section of wood | Moisture content | Time required to elevate temperature to 40°-98° C. | Treating time at 92°-98° C. | Concentration of diethyl-aminoethanol |
| Relatively heavy wood (specific gravity gas dried is above 0.6) Example: rosewood, sandalwood, ebony) | below 30% | 120 minutes | 9 minutes for each 1 mm thickness | 0.4% |
| | above 30% below 60% | 90 " | 6 minutes | 0.3% |
| | above 60% | 60 " | 4 " | 0.2% |
| Wood of medium specific gravity (specific gravity gas dried is 0.3-0.6) Example: lauan, calophyllum, zelkova tree, oak, hemlock | below 30% | 90 " | 3 " | 0.3% |
| | above 30% below 60% | 60 " | 2 " | 0.2% |
| | above 60% | 30 " | 1 minute | 0.1% |
| Wood having relatively small specific gravity (specific gravity gas dried is below 0.3) Example: N.G. basswood, amberoi, poplar, Japanese linden, Katsura tree | below 30% | 60 " | 6 minutes | 0.3% |
| | above 30% below 60% | 40 " | 4 " | 0.2% |
| | above 60% | 20 " | 2 " | 0.1% |
| Wood having relatively high resin content Example: red pine, larch, Dipterocarpus, Douglas fir | below 30% | 90-120 minutes | 3-6 min. | 0.5% |
| | above 30% below 60% | 60-90 minutes | 2-4 " | 0.4% |
| | above 60% | 30-60 minutes | 1-2 " | 0.2% |

| | | Treating condition for pressure boiler in main treating process (B) | | | |
|---|---|---|---|---|---|
| Representative section of wood | Standard temperature | Pressure condition | Concentration of diethyl-aminoethanol | Pressure, heat treating time | Reduced pressure condition 300 mm/Hg-500 mm/Hg condition |
| Relatively heavy wood (specific gravity gas dried is above 0.6) Example: rosewood, sandalwood, ebony) | 115° C. | 1.5Kg/cm$^2$ | 0.2% | 2 minutes for each 1 mm thickness | 1 minute for each 1 mm thickness |
| | 115° C. | 1.5 " | 0.2% | 1.5 min. | 1 minute |
| | 115° C. | 1.5 " | 0.2% | 1 " | 1 " |

Table 3-continued

| | | | | | |
|---|---|---|---|---|---|
| Wood of medium specific gravity | 120° C. | 2 " | 0.2% | 1.5 " | 1 " |
| (specific gravity gas dried is 0.3–0.6) | 120° C. | 2 " | 0.2% | 1 " | 1 " |
| Example: lauan, calophyllum, zelkova tree, oak, hemlock | 120° C. | 2 " | 0.2% | 0.5 " | 1 " |
| Wood having relatively small specific gravity | 120° C. | 2 " | 0.2% | 1.5 " | 1 " |
| (specific gravity gas dried is below 0.3) | 120° C. | 2 " | 0.2% | 1 " | 1 " |
| Example: N.G.basswood, amberoi, poplar, Japanese linden, Katsura tree | 120° C. | 2 " | 0.2% | 0.5 " | 1 " |
| Wood having relatively high resin content | 115° C.–120° C. | 1.5–2 Kg/cm$^2$ | 0.2% | 1.5–2 min. | 1 " |
| Example: red pine, larch, Dipterocarpus, Douglas fir | 115° C.–120° C. | 1.5–2 Kg/cm$^2$ | 0.2% | 1–1.5 min. | 1 " |
| | 115° C.–120° C. | 1.5–2 Kg/cm$^2$ | 0.2% | 0.5–1 min. | 1 " |

Drying Conditions For Artificial Drying Process C

| | |
|---|---|
| Condition at start of drying: | temperature 40° C., moisture 85%, velocity 1.5 m/sec. |
| Condition at end of drying: | temperature 60°–75° C., moisture 40%, velocity 1.2 m/sec. |
| Standard drying time: | Wood having particularly high specific gravity ratio, about 0.8–1.5 hr per 1 mm thickness. Wood having below medium specific gravity ratio, 0.5–1.2 hr per 1 mm thickness. |

NOTE:
Since there are discrepancies depending on the species treated, the conditions are approximate standards.

What is claimed is:

1. A process for treating wood, consisting essentially of:

(a) pretreatment steps consisting essentially of:

(i) dipping the wood into an aqueous alkylamine solution, alkylamine of which has a molecular weight of about 100 and a boiling point of above 90° C;

(ii) heating the wood in the solution to 92° C. to 98° C., and (iii) maintaining the wood in the solution at this temperature for a time sufficient to soften the wood without destroying its molecular structure, to permit the alkylamine solution to permeate and implant plasticity to the wood and to dissolve and remove resins, hemicellulose, rubbery and chalky substances from within the wood;

(b) main treatment steps consisting essentially of:

(i) dipping the wood treated in step (a) into an aqueous alkylamine solution as defined above;

(ii) subjecting the wood from (b) to boiling under pressure to open closed structures, to render the flow of liquids and gases within the wood more uniform and to permeate and disperse alkylamine within the wood structure;

(c) lowering the moisture content of the treated wood to the fiber saturation point by subjecting the wood to reduced pressure; and (d) drying the wood.

2. A process for treating wood as claimed in claim 1 wherein the alkylamine is selected from the group consisting of: triethylamine, ethylbutylamine or diethylaminoethanol and its concentration in said solution is 0.1–0.5%.

3. A process for treating wood as claimed in claim 2 wherein in the pretreatment, the solution contains the alkylamine in a concentration of 0.5%, the solution is heated from 40° C. to 92° C.–98° C. in about 20–120 minutes, and the wood is treated at this temperature for 1 to 9 minutes per 1 mm thickness of the treated wood.

4. A process for treating wood as claimed in claim 2 wherein in the pretreatment, the solution contains the alkylamine in a concentration of 0.1%, the solution is heated from 40° C. to 92° C.14 98° C. in about 20–120 minutes, and the wood is treated at this temperature for 20 to 120 minutes per 1 mm thickness of the treated wood.

5. A process for treating wood as claimed in claim 1 wherein the main treatment process (b) is performed at a pressure of 1.5–2.0 kg/cm$^2$, boiling time 0.5–2 minutes per 1 mm thickness of the wood and the reduced pressure of step (c) is 300–500 mm/Hg.

6. A process for treating wood as claimed in claim 1 including the process wherein after step (c), the drying of step (d) is immediately performed in a drying chamber.

* * * * *